US007255409B2

(12) United States Patent
Hu et al.

(10) Patent No.: US 7,255,409 B2
(45) Date of Patent: Aug. 14, 2007

(54) SLIDING RAIL MOUNTING STRUCTURE

(75) Inventors: Chan-Sheng Hu, Taipei (TW); Wen-Tzu Chen, Taipei (TW); Yi-Lung Chou, Taipei (TW)

(73) Assignee: Tatung Co., Ltd. (TW)

( * ) Notice: Subject to any disclaimer, the term of this patent is extended or adjusted under 35 U.S.C. 154(b) by 234 days.

(21) Appl. No.: 10/992,703

(22) Filed: Nov. 22, 2004

(65) Prior Publication Data

US 2005/0285492 A1 Dec. 29, 2005

(30) Foreign Application Priority Data

Jun. 28, 2004 (TW) ..... 93210117 U

(51) Int. Cl.
*A47B 88/00* (2006.01)

(52) U.S. Cl. ..... 312/334.4; 312/265.4; 312/223.2; 211/26

(58) Field of Classification Search ..... 312/265.1, 312/265.4, 334.4, 334.5, 223.1, 223.2; 211/26; 361/605, 724; 248/220.41, 220.43, 244, 248/245, 206.5, 537; 403/201, 231, 261
See application file for complete search history.

(56) References Cited

U.S. PATENT DOCUMENTS 3,416,761 A * 12/1968 Shanok et al. ..... 248/115
4,896,992 A * 1/1990 Muhlethaler ..... 403/297
5,833,337 A * 11/1998 Kofstad ..... 312/334.5
6,012,791 A * 1/2000 Benner et al. ..... 312/265.2
6,052,274 A * 4/2000 Remsburg ..... 361/683
6,070,957 A * 6/2000 Zachrai ..... 312/334.4
6,273,534 B1 * 8/2001 Bueley et al. ..... 312/334.8
6,450,747 B1 * 9/2002 Fischer ..... 411/174
6,523,918 B1 * 2/2003 Baiza ..... 312/265.1
6,578,939 B1 * 6/2003 Mayer ..... 312/334.5
6,590,164 B2 * 7/2003 Zachrai et al. ..... 174/149 B
6,929,336 B2 * 8/2005 Liu et al. ..... 312/223.1
2001/0040203 A1 * 11/2001 Brock et al. ..... 248/222.11
2003/0161134 A1 * 8/2003 Besserer et al. ..... 361/826
2004/0037046 A1 * 2/2004 Dittus et al. ..... 361/724
2004/0089779 A1 * 5/2004 Greenwald et al. ..... 248/241

* cited by examiner

*Primary Examiner*—Janet M. Wilkens
*Assistant Examiner*—Mart K Kuhn
(74) *Attorney, Agent, or Firm*—Bacon & Thomas, PLLC

(57) ABSTRACT

A sliding rail mounting structure is disclosed to connect a sliding rail to a vertical column inside a server rack by securing a magnetic locating member to the vertical column by magnetic attraction and then inserting the locating pin of a U-clip at one end of the sliding rail into a locating hole in the locating member and one horizontal through hole in the vertical column and then inserting two screws through respective horizontal through holes in the vertical column and threading the screws into respective threaded nuts of the U-clip.

6 Claims, 4 Drawing Sheets

SLIDING RAIL MOUNTING STRUCTURE

BACKGROUND OF THE INVENTION

1. Field of the Invention

The present invention relates to the installation of a sliding rail in a server rack and more particularly to a sliding rail mounting structure that uses a magnetic locating member to couple each end of the sliding rail to a respective column inside the server rack.

2. Description of Related Art

A regular server rack is adapted to accommodate a number of servers at different elevations. Pairs of sliding rails are provided inside the server rack and fixedly connected between two vertical columns at different elevations for receiving servers. After insertion of servers into the sliding rails, servers are locked to the sliding rails. In a standard server rack, the two vertical columns each have a plurality of rectangular through holes disposed at different elevations for the mounting of the sliding rails and the sliding rails each have a plurality of circular mounting holes at each end for connection to the rectangular through holes of the two vertical columns, and therefore a locating plate is required for use as an adapter interface between the rectangular through holes and the circular mounting holes.

FIG. 1 illustrates a sliding rail mounting structure according to the prior art. As illustrated in FIG. 1, a locating plate 91 is used to couple a sliding rail 93 to a vertical column 92. The vertical column 92 has rectangular through holes 921 at different elevations. The sliding rail 93 has circular mounting holes 931 at the angled end flange. During installation, the locating plate 91 is attached to the vertical column 92, and then the sliding rail 93 is pressed with the angled end flange at the locating plate 91 against the vertical column 92, and then screws are inserted through respective rectangular through holes 921 of the vertical column 92 and fastened to respectively through holes in the locating plate 91 and the circular mounting holes 931 of the sliding rail 93. Because the locating plate 91 is attached to the vertical column 92 before installation of the sliding rail 93, the locating plate 91 may fall from the vertical column 92 during installation of the sliding rail 93. Therefore, the worker must attach the sliding rail 93 to the locating plate 91 at the vertical column 92 carefully.

SUMMARY OF THE INVENTION

The present invention has been accomplished under the circumstances in view. It is one object of the present invention to provide a sliding rail mounting structure, which simplifies installation of a sliding rail in a server rack and saves much installation labor and time. It is another object of the present invention to provide a sliding rail mounting structure, which enhances the connection of the sliding rail to the column.

To achieve these and other objects of the present invention, the sliding rail mounting structure comprises two vertical columns fixedly provided inside a server rack, a sliding rail connectable between the two vertical columns, and two locating members adapted to mount the two ends of the sliding rail to the two vertical columns respectively. The two vertical columns each have a plurality of horizontal through holes disposed at different elevations. The sliding rail has two U-clips respectively clamped at the two distal ends thereof. Each U-clips comprises at least one fastening member protruded from a first side thereof for fastening to the corresponding horizontal through holes of one of the two vertical columns and a locating pin protruded from a second side. Each locating member comprises a flat magnetic base frame connectable to one of the two vertical columns by magnetic attraction. The flat magnetic base frame comprises at least one opening respectively aimed at a respective horizontal through hole in one of the two vertical columns, a locating hole aimed at one horizontal through hole in one of the two vertical columns for receiving the locating pin of one U-clip of the sliding rail, and a plurality of lugs perpendicularly protruded at two edges of each the at least one opening and engaged into the corresponding horizontal through holes of one of the two vertical column. Because the flat magnetic base frame of the locating member is attached to the two vertical columns and positively secured thereto by means of magnetic attraction before installation of the sliding rail, the sliding rail can easily and rapidly be fastened to the locating members and the two vertical columns with the U-clips. Preferably, each U-clip has two fastening members corresponding two openings at the respective locating member and respective horizontal through holes in the respective vertical column. The fastening members are threaded nuts connectable to the respective locating member and the respective vertical column with screws. When the screws are tightened, the U-clip is slightly deformed to enhance the clamping force, thereby securing the screws firmly in place.

DETAILED DESCRIPTION OF THE PREFERRED EMBODIMENT

Figure 1:
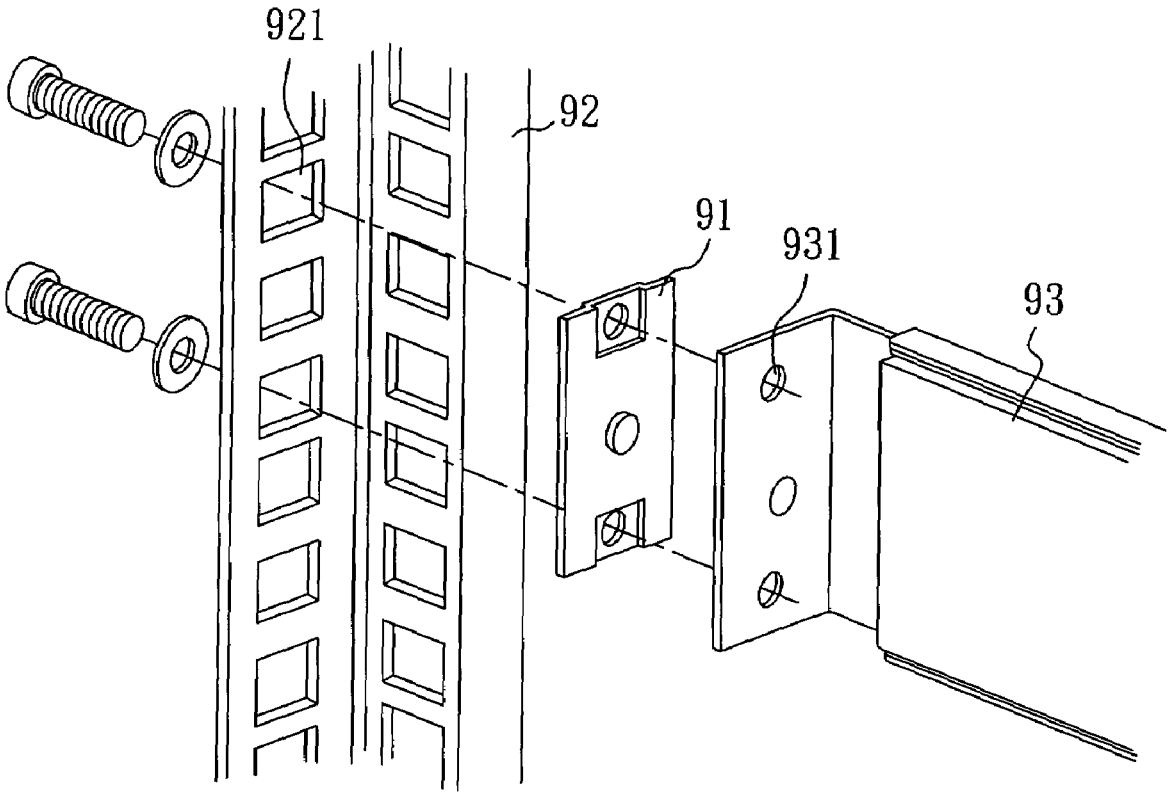
FIG. 1(Prior Art)
FIG. 1 is an exploded view showing a sliding rail mounting structure according to the prior art.
Figure 2:
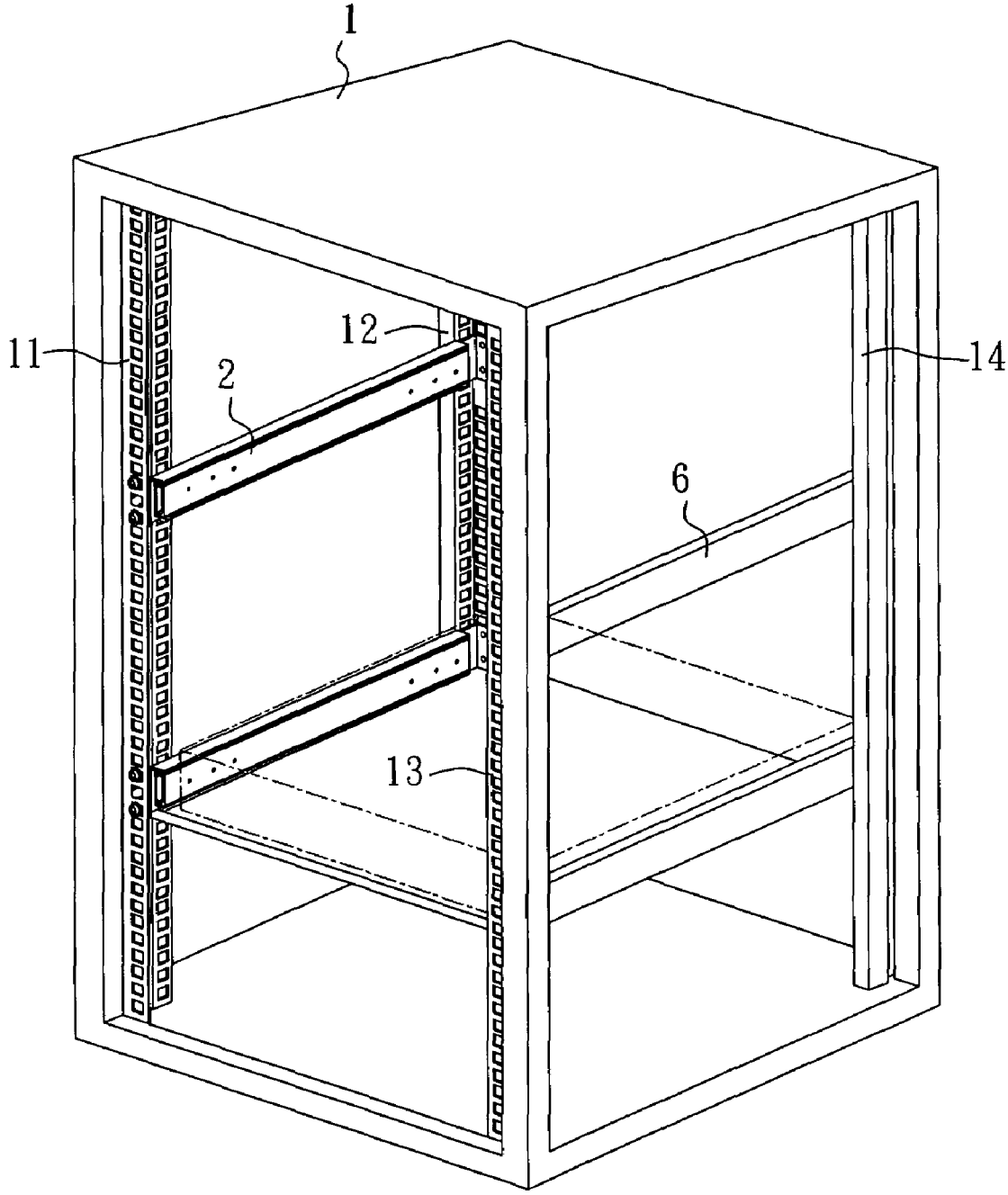
FIG. 2 is a schematic drawing showing sliding rails installed in a server rack according to the present invention.

Referring to FIG. 2, a server rack 1 is shown comprising four vertical columns 11,12,13,14 in four corners which can be magnetically attractive by magnets, a first sliding rail 2 transversely connected between two vertical columns 11,12, and a second sliding rail 6 transversely connected between the other two vertical columns 13,14. These two sliding rails 2,6 are installed in the server rack 1 in the same manner. The installation of one sliding rail 2 in the server rack 1 is explained hereinafter for understanding of the present invention.

Figure 3:
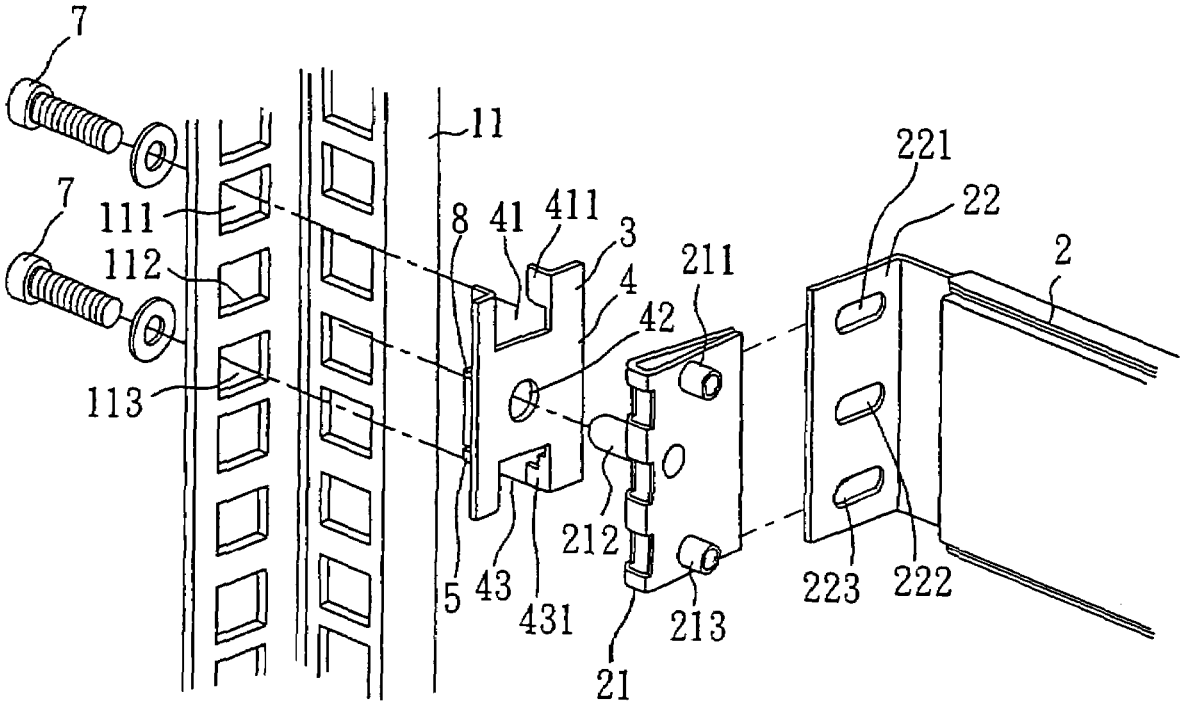
FIG. 3 is an exploded view of a sliding rail mounting structure according to the present invention.
Figure 4:
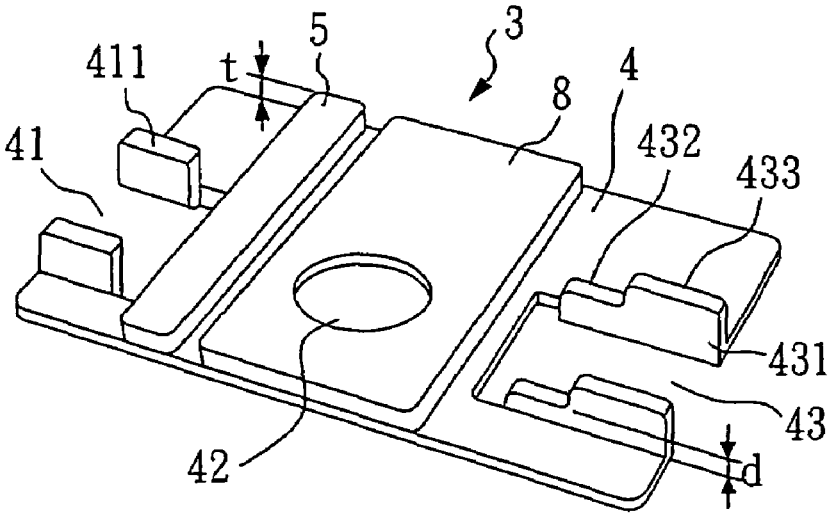
FIG. 4 is an oblique elevation of a locating member for the sliding rail mounting structure according to the present invention.
Figure 5:
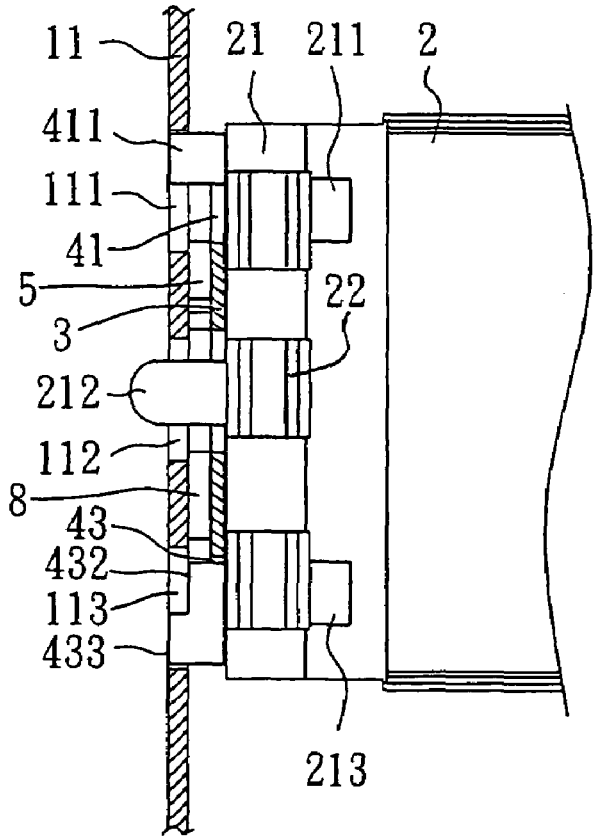
FIG. 5 is a sectional view showing the sliding rail mounting structure installed according to the present invention.

Referring to FIG. 3~FIG. 5 and FIG. 2 again, the two vertical columns 11,12 each have a plurality of vertically equally spaced and horizontally extended rectangular through holes 111,112,113. The sliding rail 2 has a flat end flange 22 at each of the two distal ends thereof. The flat end flange 22 extends from one end of the sliding rail 2 at right angles, having three oblong escape holes 221,222,223 transversely disposed at different elevations. The flat end flange 22 is fastened to one column 11 (or 12) with a U-clip 21 and a locating member 3. After connection of the U-clip 21 to one flat end flange 22 of the sliding rail 2, the U-clip 21 can be moved horizontally relative to the sliding rail 2 to the desired position within the constraint of the oblong escape holes 221,222,223.

The U-clip 21 comprises two fastening members, for example, threaded nuts 211,213 perpendicularly extended from one side and respectively disposed near the top and bottom sides, and a locating pin 212 perpendicularly extended from the other side on the middle.

The locating member 3 is comprised of a flat magnetic base frame 4 and a flat magnetic bar 5. The flat magnetic base frame 4 in this embodiment is made of magnetic material; of course the flat magnetic base frame 4 can be made of unmagnetized steel which can be attracted by the flat magnetic bar 5. The flat magnetic base frame 4 has a first rectangular opening 41 formed in one end, a second rectangular opening 43 formed in the other end, a locating hole 42 spaced between the first rectangular opening 41 and the second rectangular opening 43, two first lugs 411 perpendicularly protruded at two opposite lateral edges of the first rectangular opening 41, and two second lugs 431 perpendicularly protruded at two opposite lateral edges of the second rectangular opening 43. Each second lug 431 has a substantially L-shaped profile, forming a first face 432 at a relatively lower elevation and a second face 433 at a relatively higher elevation. The first face 432 is spaced from the flat magnetic base frame 4 at a height d.

The flat magnetic bar 5 is fixedly fastened to the flat magnetic base frame 4 adjacent to the first rectangular opening 41, having a thickness t approximately equal to the height d between the first face 432 of each second lug 431 and the flat magnetic base frame 4.

Before installation of the sliding rail 2 in the vertical column 11 (or 12) of the server rack 1, the locating member 3 is fastened to the vertical column 11 (or 12) by means of magnetic attraction between the flat magnetic bar 5 and the vertical column 11 (or 12). Because the thickness t of the flat magnetic bar 5 is approximately equal to the height d between the first face 432 of each second lug 431 and the flat magnetic base frame 4, the flat magnetic base frame 4 is maintained in parallel to the vertical column 11 (or 12) when attached to the vertical column 11 (or 12) (see FIG. 5).

When the locating member 3 is attached to the vertical column 11 (or 12), the first rectangular opening 41, locating hole 42 and second rectangular opening 43 of the flat magnetic base frame 4 are respectively aimed at three adjacent rectangular through holes 111,112,113 of the vertical column 11 (or 12), the first lugs 411 are engaged into one rectangular through hole 111, and the second lugs 431 are engaged into another rectangular through hole 113.

The sliding rail 2 can then be fastened to the vertical column 11 (or 12). At this time, one threaded nut 211 of the U-clip 21 is aligned with at the first rectangular opening 41 of the flat magnetic base frame 4 of the locating member 3 and the corresponding rectangular through hole 111 in the vertical column 11 (or 12), the other threaded nut 213 of the U-clip 21 is aligned with the second rectangular opening 43 of the flat magnetic base frame 4 of the locating member 3 and the corresponding rectangular through hole 113 in the vertical column 11 (or 12), and the locating pin 212 of the U-clip 21 is inserted into the locating hole 42 of the flat magnetic base frame 4 of the locating member 3 and the corresponding rectangular through hole 112 in the vertical column 11 (or 12). Thereafter, two screws 7 are respectively inserted through the rectangular through holes 111,113 and the first rectangular opening 41 and second rectangular opening 43 of the flat magnetic base frame 4 of the locating member 3 and threaded into the threaded nuts 211,213 of the U-clip 21.

As indicated above, the flat magnetic base frame 4 is attached to the vertical column 11 (or 12) of the server rack 1 and positively secured thereto by means of magnetic attraction before installation of the sliding rail 2. After connection of the locating member 3 to the vertical column 11 (or 12) of the server rack 1, the sliding rail 2 can easily and rapidly be fastened to the vertical column 11 (or 12) of the server rack 1 with the U-clip 21 and the screws 7.

Further, the U-clip 21 is slightly compressible. When tightening the screws 7, the U-clip 21 is slightly deformed to enhance the clamping force, thereby securing the screws 7 firmly in place.

Further, the openings 41, 43 of the flat magnetic base frame 4 are rectangular openings to match the rectangular shape of the through holes 111,112,113 of the vertical column 11 (or 12). The locating hole 42 of the flat magnetic base frame 4 is a circular hole fitting the locating pin 212 of the U-clip 21. Further, the fastening members 211,213 of the U-clip 21 are screwed nuts respectively aimed at the openings 41,43 of the flat magnetic base frame 4 and corresponding through holes 111,113 of vertical column 11 (or 12) for receiving the screws 7. Therefore, by means of the flat magnetic base frame 4 and the U-clip 21, rectangular through holes 111,112,113 of the vertical column 11 (or 12) are converted into circular holes for quick installation.

Referring to FIG. 3~FIG. 5 again, an adhesive foam pad 8 may be used with the locating member 3. The adhesive foam pad 8 has one side adhered to the flat magnetic base frame 4 and the other side adhered to the vertical column 11 (or 12) of the server rack 1. The adhesive foam pad 8 enhances bonding of the locating member 3 to the vertical column 11 (or 12) of the server rack 1. The adhesive force of the adhesive foam pad 8 makes up for insufficiency of magnetic attraction between the flat magnetic bar 5 and the vertical column 11 (or 12) of the server rack 1 (for example, in case the vertical column 11 (or 12) of the server rack 1 is made of aluminum).

Although the present invention has been explained in relation to its preferred embodiment, it is to be understood that many other possible modifications and variations can be made without departing from the spirit and scope of the invention as hereinafter claimed.

What is claimed is:

1. A sliding rail mounting structure comprising:

two vertical columns fixedly provided inside a server rack, said two vertical columns each having a plurality of horizontal through holes disposed at different elevations;

a sliding rail connected between said two vertical columns in horizontal, said sliding rail having an end flange at each of two distal ends thereof, and two U-clips respectively clamped to said flanges, each said U-clips comprising at least one fastening member protruded from a first side thereof and fastened to the corresponding horizontal through holes of one of said two vertical columns and a locating pin protruded from a second side thereof; and two locating members mounting the two U-clips of said sliding rail to said two vertical columns respectively, each said locating member comprising a flat magnetic base frame connected to one of said two vertical columns by magnetic attraction, said flat magnetic base frame comprising at least one opening respectively aimed at a respective horizontal through hole in one of said two vertical columns, a locating hole aimed at one horizontal through hole in one of said two vertical columns for receiving the locating pin of one U-clip of said sliding rail, and a plurality of lugs perpendicularly protruded at two edges of each said at least one opening and engaged into the corresponding horizontal through holes of one of said two vertical columns.

2. The sliding rail mounting structure as claimed in claim 1, wherein the flat magnetic base frame of each said locating member is fixedly provided with a magnet for attaching to one of said two vertical columns.

3. The sliding rail mounting structure as claimed in claim 2, wherein said at least one opening of said flat magnetic base frame includes a first opening and a second opening respectively formed in two opposite ends of said flat magnetic base frame; said lugs of said flat magnetic base frame include two first lugs respectively formed at two edges of said first opening and two second lugs respectively formed at two edges of said second opening, each said second lug having a substantially L-shaped profile and forming a first face at a relatively lower elevation and a second face at a relatively higher elevation, said first face being spaced from said flat magnetic base frame at a height; said magnet is fixedly mounted to said flat magnetic base frame adjacent to one side of said second opening, having a thickness approximately equal to the height of the first face of each said second lug.

4. The sliding rail mounting structure as claimed in claim 3, wherein the first opening, locating hole and second opening of said flat magnetic base frame are respectively aimed at three adjacent horizontal through holes in one of said two vertical columns; the at least one fastening member of each U-clip of said sliding rail includes a first fastening member and a second fastening member respectively aimed at the first opening and second opening of the flat magnetic base frame of the respective locating member.

5. The sliding rail mounting structure as claimed in claim 4, wherein the first fastening member and second fastening member of each U-clip of said sliding rail are threaded nuts.

6. The sliding rail mounting structure as claimed in claim 3, wherein the horizontal through holes of said two vertical columns are rectangular holes; and the first opening and second opening of said flat magnetic base frame are rectangular openings.

* * * * *